United States Patent [19]

Locher

[11] Patent Number: 4,502,729

[45] Date of Patent: Mar. 5, 1985

[54] CHAIR, ESPECIALLY A RECLINING CHAIR

[75] Inventor: Hermann Locher, Dornach, Switzerland

[73] Assignee: Giroflex Entwicklungs AG, Koblenz, Switzerland

[21] Appl. No.: 401,617

[22] Filed: Jul. 26, 1982

[30] Foreign Application Priority Data

Aug. 19, 1981 [WO] PCT Int'l Appl. ..... PCT/CH81/00094

[51] Int. Cl.[3] ..... A47C 3/00

[52] U.S. Cl. ..... 297/301; 297/300; 297/320; 297/343

[58] Field of Search ..... 297/316, 320, 321, 343, 297/300, 301, 304

[56] References Cited

U.S. PATENT DOCUMENTS

| | | | |
|---|---|---|---|
| 868,052 | 10/1907 | Wilmot | 297/320 |
| 1,701,452 | 2/1929 | Hillin | 297/343 |
| 1,928,857 | 10/1933 | Kelly | 297/343 |
| 2,471,024 | 5/1949 | Cramer | 297/301 |
| 2,558,171 | 6/1951 | Chesley . | |
| 2,616,484 | 11/1952 | Christie | 297/320 |
| 3,602,537 | 8/1971 | Keustholt | 297/316 |
| 4,411,469 | 10/1983 | Drabert et al. | 297/321 |

FOREIGN PATENT DOCUMENTS

| | | | |
|---|---|---|---|
| 120698 | 11/1970 | Norway | 297/320 |

*Primary Examiner*—William E. Lyddane
*Assistant Examiner*—Mark W. Binder
*Attorney, Agent, or Firm*—Werner W. Kleeman

[57] ABSTRACT

A reclining chair is disclosed containing a conventional seat portion pivotable about a fixed pivot shaft or axle and a backrest containing a backrest plate displaceable upon guide rails. These guide rails are pivoted to a greater extent than the seat during the rearward reclining of the seat, due to the action of a guide element connected with a piston rod of a pneumatic spring arrangement. Due to the movement of the guide element there is rotated a transmission lever pair about a stationary pivot shaft, the transmission lever pair being connected with the guide element. A curved entrainment member, hingedly connected with this transmission lever pair, is connected with the backrest plate. Since a pivot shaft between the transmission lever pair and the curved entrainment member moves through an appreciably larger distance than the connection location between the seat and the guide element or the guide rails, the backrest plate is downwardly drawn along the guide rails. By virtue of this adjustment mechanism there is ensured that the backrest plate follows that course of movement which is performed by the back of the user during reclining of the chair.

8 Claims, 5 Drawing Figures

CHAIR, ESPECIALLY A RECLINING CHAIR

BACKGROUND OF THE INVENTION

The present invention broadly relates to chairs and, more specifically, concerns a new and improved construction of reclining chair.

The chair of the present development is of the type comprising a seat or seat portion which can be pivoted about a horizontal pivot shaft rearwardly into an inclined or reclined position, and a backrest or backrest portion is mounted at the seat. This backrest, during the pivoting of the seat, likewise pivots into an inclined or reclined position about a shaft arranged at the seat, but owing to the operation of a reclining mechanism which comes into play the backrest moves through a larger pivot angle than that of the seat.

Chairs, particularly office chairs, of this type of design have been known to the art for quite some time. They afford an appreciable seating comfort, since, on the one hand, they provide a good support of the back of the user in the starting or work position by virtue of the practically vertical position of the backrest, and, on the other hand, however, in the rearwardly inclined or reclined position of the chair render possible a relaxed sitting of the user, when assuming the so-called relaxed or reclined position.

However, such type of chairs possess certain drawbacks. If the angle between the seat and the backrest enlarges in the manner explained, then the upper portion of the body of the user does not simply carry out a pivotal movement, rather there occurs a movement which is a composite of different superimposed movements. The result of such resultant movement is that the back of the user, during reclining of the backrest, performs a movement where each individual point or location of the user's back moves through a rather steep downwardly descending curve. However, the backrest cannot follow such movements. Even the backrest moves since it is mounted at the rear end of the seat, and this end during downward tilting also pivots downwardly while it simultaneously performs the pivotal movement. However, its movement curve is less steep, so that there occurs a relative movement between the back of the user and the backrest.

SUMMARY OF THE INVENTION

Therefore, with the foregoing in mind it is a primary object of the present invention to provide a new and improved construction of chair, especially a reclining chair, which is not afflicted with the aforementioned drawbacks and limitations of the prior art reclining chair constructions.

Another and more specific object of the present invention is directed to a new and improved construction of reclining chair which enables avoiding, or at least reducing, such relative movement between the user's back and the backrest to such an extent that it no longer is noticeable to the user.

Still a further significant object of the present invention is directed to a new and improved construction of chair, especially a reclining chain, which affords a unique movement of the backrest with respect to the seat of the chair during reclining of the chair, so that there does not arise any perceivable relative movement between the back of the user and the backrest of the chair.

Another noteworthy object of the present invention is directed to a new and improved construction of reclining chair containing an adjustment mechanism and a reclining mechanism which coact with one another such that movement of the chair from an upright position into a reclined position can be accomplished with a minimum of effort, while ensuring for a protective reclining of the backrest of the chair without there arising any appreciable relative movements between the back of the user and the backrest.

Now in order to implement these and still further objects of the invention, which will become more readily apparent as the description proceeds, the invention contemplates that, generally speaking, the reclining chair of the present development is of the type wherein the backrest contains a backrest plate or plate member which is drawn downwardly along a guide arrangement towards the seat during its reclining movement, by the action of an adjustment mechanism or device which is activated by the pivotal movement of the backrest. According to important aspects of the invention the adjustment mechanism of the backrest plate and the reclining mechanism of the backrest conjointly possess a common pivot shaft which is pivotable about a stationary shaft. The adjustment mechanism contains a transmission lever pair which interconnects both of these shafts. The transmission lever pair is rotatable about the stationary shaft and is prolonged to extend therepast. The transmission lever pair, during the movement of the common pivot shaft, initiates a movement of the backrest plate which is larger in comparison thereto.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
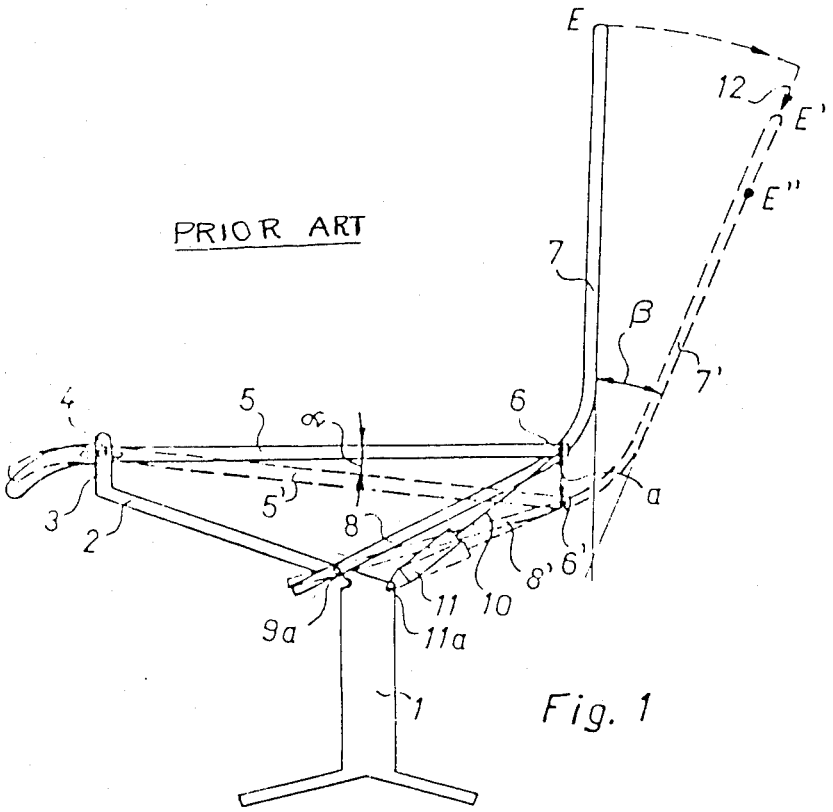
FIG. 1 schematically illustrates a prior art construction of chair and its mode of operation.
Figure 2:
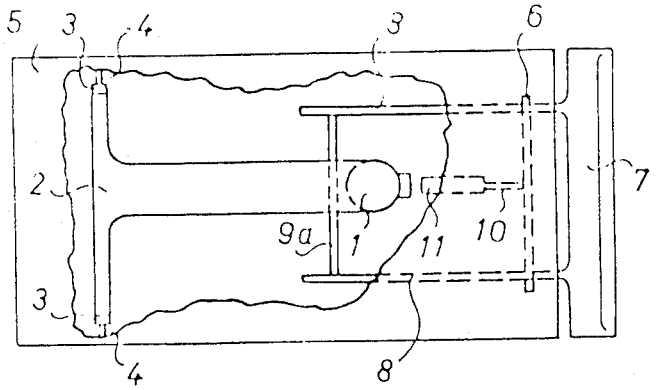
Fig. 2 PRIOR ART
FIG. 2 is a top plan view of the chair of FIG. 1, wherein there has been partially broken away a portion of the seat in order to reveal structure located therebelow.

Turning attention now to the drawings, in order to fully appreciate the course of the movements and the mode of operation of the reclining chair of the present development, there will be initially explained the workings of a prior art construction of chair as has been shown in FIGS. 1 and 2. Reference numeral 1 designates the support column or tubular pedestal of the chair of the prior art depicted in FIG. 1. This chair will be seen to contain a seat support 2 provided with the upstanding brackets 3, only one of which is visible in the illustration of FIG. 1, these brackets 3 being provided with a pivot shaft 4 for the seat 5, such pivot shaft 4 being formed by pivot pins or the like. The upright support column 1, the seat support or carrier 2, the brackets 3, and thus, also the pivot shaft 4 are to be considered as stationary for the purpose of the following explanations. Also these components have been therefore illustrated in FIGS. 1 and 2 as if they formed a single unit or component. The seat 5 constitutes the first of the movable parts or components in that it is pivotable about the pivot shaft 4. The seat 5 is shown by solid lines in FIG. 1 in its normal seating position, whereas the phantom lines designated by reference numeral 5' depict the seat in its reclined or inclined position into which it can be brought by the user leaning back in the chair. The pivot angle between the starting full line position of the seat 5 and the inclined seat position 5' has been designated by reference character $\alpha$. At its rear end the seat 5 possesses a pivot shaft 6. Pivotably mounted at this pivot shaft 6 is a further movable part or component, namely the backrest generally designated in its entirety by reference numeral 7.

This backrest 7 continues beneath the pivot shaft 6 in the form of a guide element or portion 8 composed of two parallel supports or carriers, wherein in FIG. 1 only one of these supports or carriers is visible. This guide element or portion 8 is thus rigidly connected with the backrest 7. The seat 5 is furthermore not only pivotable about the pivot shaft 4, but also is mounted to be lengthwise displaceable, as will be apparent from the following explanations. The guide element or portion 8 is pivotable about a pivot shaft 9*a* mounted at the rigid seat carrier or support 2, and since such is accordingly stationary it forms the center of the pivotal movement of all of the movable parts, in other words the seat 5, the backrest 7 and the guide element or portion 8 together with the pivot shaft 6. It therefore follows, especially when considering FIG. 1, that the seat 5 not only pivots about the pivot shaft 4, but also can be displaced along such pivot shaft 4, something which can be readily accomplished through the provision of suitable means, typically for instance elongate holes or slots.

Likewise hingedly connected at the pivot shaft 6 is a piston rod 10 of a piston-and-cylinder unit 11, usually a so-called pneumatic spring arrangement 11 of conventional construction, which likewise must be pivotably mounted owing to the movement of the pivot shaft 6, and specifically at the upper end of the upright support column 1 at the pivot point 11*a*. Since the spacing of the pneumatic spring-pivot point 11*a* from the pivot shaft 6 is smaller than the constant spacing between the pivot shafts 9*a* and 6 from one another, and since this pivot point 11*a* additionally is located adjacent the connection line between both of the aforementioned pivot shafts 9*a* and 6, its distance from the pivot shaft 6 is decreased during the rearward movement, in other words, during the positional change of the latter. Consequently, the pneumatic or gas spring arrangement 11 is compressed, with the result that it is blocked, as is conventional, in each position of itsl piston, and thus, there is also realized the spring or resilient action during the rearward reclining of the chair.

If during this rearward movement of the chair the seat shifts from the seat position 5 into the seat position 5', then, as already explained, the pivot shaft 6 likewise alters its position. This new position of the pivot shaft has been designated by reference character 6'. In so doing it moves through a path which has been designated by reference character a. Due to this movement also the guide element or portion 8 changes its position since it, of course, carries the pivot shaft 6. Its new position 8' forms with the old position 8 an angle which is greater than the angle $\alpha$. Since the backrest 7 is rigidly connected with the guide portion or element 8 it also alters its position by the same amount. Also it pivots through this angle, which has been designated by reference character $\beta$, from the backrest position 7 into the backrest position 7'. In this position it possesses relative to the seat a greater angle than in the starting or upright position.

FIG. 2 schematically illustrates several details of the construction of the prior art chair shown in FIG. 1. The seat 5 has been conveniently partially broken away in order to reveal elements or parts located therebelow. There will be recognized that the seat support or carrier 2 appreciably widens at its front end, in other words, possesses a substantially T-shaped configuration, in order to support at the outer extremities of the T-portion the respective brackets 3. The pivot shaft or axis 4 can consist of, as illustrated, two short pivot stubs or pins about which there can pivot the seat 5. On the other hand, the other pivot shaft 6 is continuous because of the mounting of the piston rod 10 thereat; it is attached in known and therefore not here further shown fashion at the underside of the seat 5. In order to demonstrate that the guide element or portion 8, composed of the aforementioned two supports, and the backrest 7 are rigidly interconnected with one another, these parts have been illustrated as a single part or component.

Based upon the illustration of FIG. 1 it therefore will be apparent that the backrest 7 not only performs an arcuate pivotal movement, but also is lowered through the distance a. If there is considered a random point at the backrest, for instance the upper end E, then it will be recognized that this upper end E migrates in the direction of the indicated arrows 12 towards the loction E'.

Figure 4:
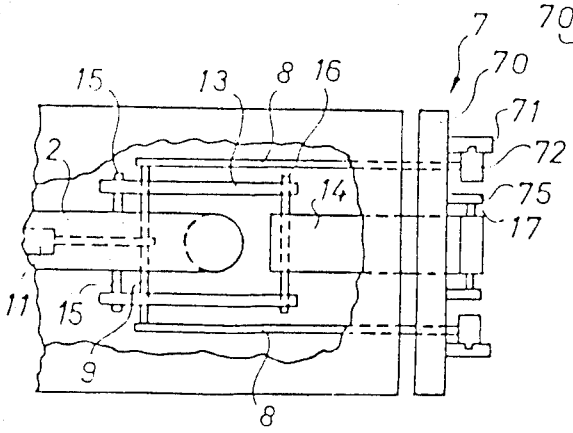
FIG. 4 is a view, similar to the illustration of FIG. 2, but constituting a top plan view of the inventive chair depicted in FIG. 3.
Figure 5:
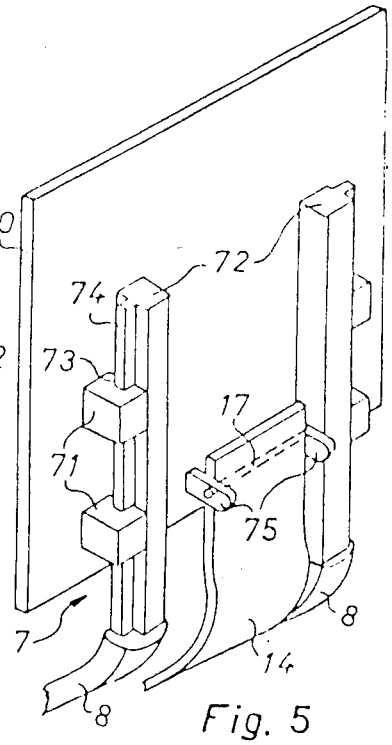
FIG. 5 is a perspective view of the guide arrangement or guide for the movable backrest plate or plate member.

However, it can be demonstrated that the back of a human being does not participate in the same movement. Quite to the contrary, it accomplishes a movement wherein a corresponding point or location, for instance bearing upon the aforementioned point E, during the rearward reclining of the chair, migrates to a point E" which is located appreciably lower than the point E'. The backrest 7, viewed relative to the back of the user, has thus carried out an upward movement. This relative displacement, which because of its effect upon male users of the reclining chair has become known in the art as the "shirt withdrawal or pulling-out effect", is intended to be avoided with the chair of the instant development. Such improved construction of reclining chair as contemplated by the present invention has been depicted in FIGS. 3 to 5.

Figure 3:
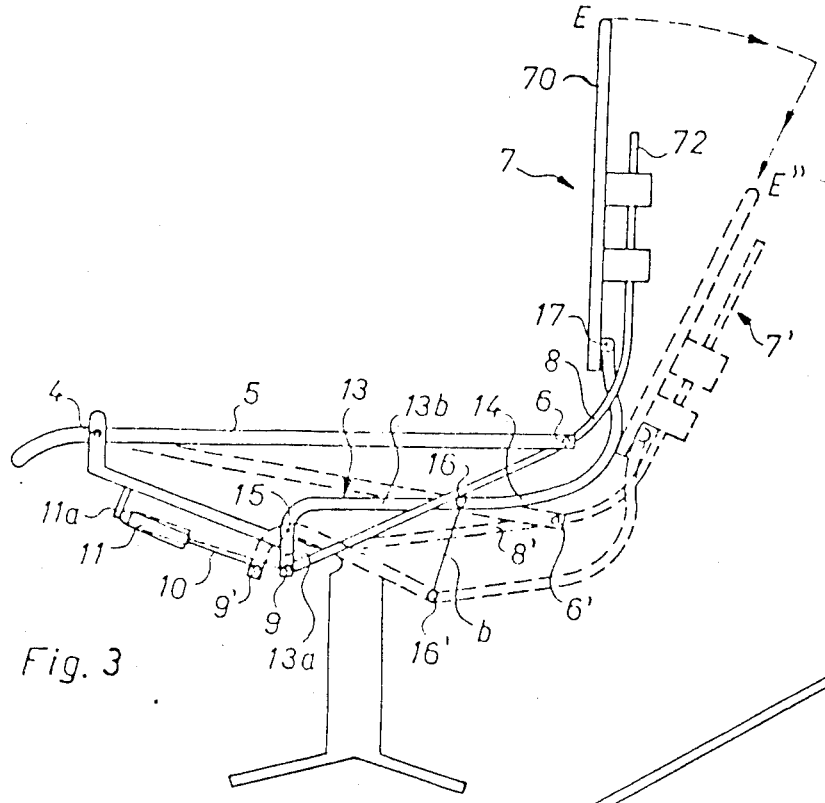
FIG. 3 is a view, similar to the illustration of FIG, 1, but showing a chair constructed according to the invention.

By now inspecting FIG. 3 there will be initially recognized at least certain of the same parts or components as appear in the chair construction of FIG. 1, and therefore the same or comparable components have been generally conveniently designated by the same reference characters. In the inventive chair construction depicted in FIG. 3 the backrest or backrest portion 7 has been modified somewhat in its design, as will be explained more fully hereinafter. Also changed is the position of the pneumatic or gas spring arrangement 11. It is now attached to be pivotable at the seat carrier or support 2. What has been also omitted is the hinged connection of the guide element or portion 8 at the seat carrier or support 2, in other words the pivot shaft 9*a*.

It is replaced by a pivot shaft 9 provided at the end of the guide portion or element 8. On the other hand, a totally new element has been incorporated which is constituted by the approximately L-shaped transmission lever pair 13, only one lever of which is visible in the showing of FIG. 3, and a curved entrainment portion 14. The transmission lever pair 13 has three hinge locations or pivots. With the shorter leg member 13*a* of each of the L-shaped levers the lever pair 13 is hingedly connected with the common pivot shaft 9 of the guide element or portion 8 and with the piston rod 10 of the pneumatic or gas spring arrangement 11. A further hinge or pivot location is designated by reference character 15. This hinge location 15 constitutes the actual pivot shaft which is stationarily mounted at the non-movable seat support or carrier 2 and about which rotates the transmission lever pair 13. The last hinge location or pivot point is located at the longer leg member 13*b* of each lever of the lever pair 13 and it is formed by a pivot shaft 16 with which there is pivotably connected the curved entrainment portion 14 at the transmission lever pair 13, as best seen by referring to FIG. 4.

The curved entrainment portion 14, which may be constituted by a rigid curved elongate plate member, is hingedly connected at its other end at a backrest plate or plate member 70. Details thereof can be particularly well seen by inspecting FIG. 5 which will be discussed in greater detail hereinafter. This backrest plate 70 is slidingly mounted by means of the slide blocks 71 or equivalent structure at a guide arrangement or guide means composed of two guide rails 72 which form a direct extension of each support or carrier of the guide element or part 8. According to the showing of FIG. 5, each of the slide blocks or slides 71 possesses a recess or channel 73 with which engages a protruding rib member or nose 74 of each related guide rail 72. There will be particularly also recognized by inspecting FIG. 5 that the curved entrainment portion 14 is hingedly or pivotably connected by means of a pivot shaft 17 with the backrest plate or plate member 70, and such pivot shaft 17 piercingly extends through two brackets 75 rigidly mounted at the plate 70.

The mode of operation of the reclining chair of the invention now will be explained, particularly based upon the illustration of FIG. 3. If the seat 5 is reclined, then the guide part of element 8 of the reclining mechanism changes its position into the phantom line position 8', as already explained. However, because the transmission lever pair 13 is connected with the guide element or portion 8 by means of the pivot shaft 9, the shifting of the pivot shaft 9 into the position 9' causes an entrainment of each leg member 13*a*. Because of the provision of the stationary pivot shaft 15 the transmission lever pair 13 of the adjustment mechanism rotates about such pivot shaft 15. The ends of the leg member 13*a* therefore perform a circular or arcuate movement. It is therefore necessary to also pivotably mount the pneumatic or gas spring arrangement 11. However, as apparent from the showing of FIG. 3, the pivotal movement of the pneumatic spring arrangement 11 is extremely slight because of the relative position of the piston rod 10 to the leg members 13*a*, so that such has practically no effect upon the movement of the guide part or element 8.

The rotational movement of the transmission lever pair 13 now has the effect that, because of the unequal length of both leg members 13*a* and 13*b* of each lever of the lever pair, the ends of the leg members 13*b* carry out an unequally larger i.e. a stepped-up movement. Consequently, the hinge location or pivot shaft 16 performs a circular or arcuate motion about the hinge location or pivot shaft 15 which serves as the center, and thus, moves through a distance which has been designated by reference character b in FIG. 3. It will be readily apparent that this distance b is appreciably greater than the distance a, constituting the movement of the pivot shaft 6 into the phantom line position 6' shown in FIG. 1. The curved entrainment member 14 is thus downwardly drawn more intensively and therefore downwardly pulls the backrest plate member 70 along the guide rails 72, although such themselves have only moved downwardly through the distance a. Hence, there has been attained the strived for effect. If there is again considered the point E of the backrest plate or plate member 70, then this point migrates during the course of the reclining movement of the chair towards the point or location E", in other words to the point at which, as previously explained, there also moves the corresponding location or point of the back of the user. The undesirable relative displacement between the backrest of the chair and the back of the user no longer takes place, something which becomes appreciably discernible by virtue of the markedly noticeable seating comfort. The degree of such movement of the backrest plate member 70 is governed by the geometry of the adjustment mechanism, especially that of the transmission lever pair 13.

The here illustrated exemplary embodiment of reclining chair therefore possesses a mechanical adjustment mechanism or device. However, it should be understood that also other adjustment mechanisms can be beneficially used for bringing about the same effect, for instance hydraulic or electrical adjustment mechanisms or devices. Equally, it is to be mentioned that particularly when using such adjustment mechanisms there also can occur a reverse relative movement between the backrest and the seat in that, namely, the latter is raised during the reclining or inclination, whereas the backrest or the backrest plate member only inclines. Due to the raising of the seat there also is realized in this case the same relative displacement between the seat and the backrest as was accomplished with the illustrated exemplary embodiment of inventive reclining chair.

While there are shown and described present preferred embodiments of the invention, it is to be distinctly understood that the invention is not limited thereto, but may be otherwise variously embodied and practiced within the scope of the following claims. Accordingly,

What I claim is:

1. A reclining chair comprising:

a seat having a rear edge;

a backrest cooperating with the rear edge of the seat;

rigid seat support means including means defining a stationary pivot axis about which the seat can be pivoted rearwardly into a reclining position;

said backrest moving downwardly along with the rear edge of the seat during the reclining of said seat;

means defining a movable pivot axis for the backrest and which movable pivot axis is mounted at the seat;

said backrest being simultaneously pivotable about the movable pivot axis mounted at the seat;

a reclining mechanism provided for said backrest and inclining a guide element and a spring arrangement, with said guide element cooperating with said spring arrangement and with said means defining said movable pivot axis;

said reclining mechanism ensuring that the backrest moves through a larger pivot angle than the pivot angle of the seat during pivoting of the backrest;

said backrest containing a backrest plate member capable of pivotal motion;

a guide arrangement provided for said backrest plate member;

an adjustment mechanism actuatable during the pivotal motion of the backrest plate member for drawing the backrest plate member along said guide arrangement downardly towards the seat;

means defining a common pivot axis for said adjustment mechanism of the backrest plate member and the reclining mechanism of the backrest;

said rigid seat support means further including means defining a fixed pivot axis situated in fixed spaced relationship to said stationary pivot axis and about which there is pivotable said common pivot axis;

said adjustmet mechanism comprising a transmission lever pair;

said transmission lever pair interconnecting said common pivot axis and said fixed pivot axis and being rotatable about said fixed pivot axis;

said transmission lever pair extending past said fixed pivot axis; and said transmission lever pair during the movement of the common pivot axis initiating a movement of the backrest plate member which is greater in comparison thereto.

2. The reclining chair as defined in claim 1, wherein:

said transmission lever pair comprises two essentially L-shaped levers having leg members of unequal length;

said adjustment mechanism further comprising a curved entrainment member cooperating with said transmission lever pair;

said curved entrainment member having first and second ends;

means defining an adjustment pivot axis for hingedly connecting said first end of the curved entrainment member with the transmission lever pair; and means defining a backrest pivot axis for hingedly connecting said second end of the curved entrainment member with the backrest plate member.

3. The reclining chair as defined in claim 2, further including:

said common pivot axis for the reclining mechanism and the adjustment mechanism is located at a shorter leg member of each L-shaped lever of the transmission lever pair;

said transmission lever pair being rotatable about a stationary shaft constituting said means defining said fixed pivot axis; and said stationary shaft piercingly extending through a connection location of both of the leg members and being mounted at said rigid seat support means.

4. The reclining chair as defined in claim 1, wherein:

said guide arrangement for the backrest plate member comprises two rail members; and each of said rail members being rigidly connected at one end thereof with said guide element of the reclining mechanism of the backrest.

5. A reclining chair, comprising:

rigid seat support means;

first pivot means provided at said rigid seat support means for defining a stationary first pivot axis;

second pivot means provided at said rigid seat support means for defining a stationary second pivot axis in spaced relationship to said stationary first pivot axis;

a seat member for supporting the buttocks of an occupant;

said seat member having a rear edge and a region remote from said rear edge;

said remote region of said seat member being supported at said first pivot means to pivot about said stationary first pivot axis for effecting a substantially downward motion of said rear edge of said seat member;

third pivot means provided at said rear edge of said seat member for defining a movable third pivot axis having an arcuate motion about said stationary first pivot axis;

a backrest structure for supporting the back of an occupant;

a reclining mechanism for imparting a rearward reclining motion to said backrest structure in relation to said substantially downward motion of said rear edge of said seat member such that the angular extent of said reclining motion of said backrest is greater than the angular extent subtended about said stationary first pivot axis by said substantially downward motion of said seat member;

said reclining mechanism including a guide element and a spring arrangement and said guide element cooperating with said spring arrangement and pivotably supported at said third pivot means to pivot about said movable third pivot axis for participating in said substantially downward motion of said rear edge of said seat member;

said guide element having a predominantly vertical guide portion;

said backrest structure including guide means for translatably guiding said backrest structure along said predominantly vertical guide portion of said guide element of said reclining mechanism;

a control mechanism for defining in cooperation with said rear edge of said seat member a reclining motion of said reclining mechanism and for simultaneously defining a downward motion of said backrest structure toward said seat member along said predominantly vertical portion of said guide element of said reclining mechanism in dependent relation to said reclining motion;

fourth pivot means provided at said control mechanism for defining a movable fourth pivot axis having an arcuate motion about said stationary second pivot axis; and said control mechanism including a transmission lever pair pivotably mounted at said second pivot means to pivot about said stationary second pivot axis for defining said arcuate motion of said movable fourth pivot axis and for operatively connecting said control mechanism with said backrest structure for effecting said downward motion of said backrest structure by an amount greater than said arcuate motion of said movable fourth pivot axis.

6. The reclining chair as defined in claim 5, further including:

an entrainment member having a first end and a second end;

said transmission lever pair comprising two lever members each having a short leg and a long leg;

fifth pivot means provided at said long legs of said lever members for defining a movable fifth pivot axis having an arcuate motion about said stationary second pivot axis;

sixth pivot means provided at said backrest structure for defining a translatable sixth pivot axis having a predominantly vertical motion along said guide portion; and said first end of said entrainment member pivotably engaging said fifth pivot means and said second end of said entrainment member pivotably engaging said sixth pivot means for operatively connecting said transmission lever pair with said backrest structure.

7. The reclining clair as defined in claim 6, wherein:

said fourth pivot means is provided at said short legs of said lever members of said transmission lever pair; and said second pivot means comprising a stationary shaft extending through said lever members.

8. The reclining chair as defined in claim 5, wherein:

said guide portion of said guide elements of said reclining mechanism comprises two guide rails; and said two guide rails being rigidly connected with said guide element.

* * * * *

UNITED STATES PATENT AND TRADEMARK OFFICE

CERTIFICATE OF CORRECTION

PATENT NO. : 4,502,729

DATED : March 5, 1985

INVENTOR(S) : HERMANN LOCHER

It is certified that error appears in the above-identified patent and that said Letters Patent is hereby corrected as shown below:

Column 3, line 59, please delete "itsl" and insert --its--

Column 7, line 22, please delete "adjustmet" and insert --adjustment--

Signed and Sealed this

*Twenty-third* Day of *July 1985*

[SEAL]

*Attest:*

DONALD J. QUIGG

*Attesting Officer* *Acting Commissioner of Patents and Trademarks*